US008442800B2

(12) United States Patent
Lindström et al.

(10) Patent No.: US 8,442,800 B2
(45) Date of Patent: May 14, 2013

(54) METHOD AND SYSTEM FOR DETECTING EVENTS

(75) Inventors: Juha Lindström, Espoo (FI); Otso Auterinen, Helsinki (FI)

(73) Assignee: Marimils Oy, Vantaa (FI)

( * ) Notice: Subject to any disclaimer, the term of this patent is extended or adjusted under 35 U.S.C. 154(b) by 308 days.

(21) Appl. No.: 12/919,911

(22) PCT Filed: Feb. 25, 2009

(86) PCT No.: PCT/FI2009/050157

§ 371 (c)(1),
(2), (4) Date: Aug. 27, 2010

(87) PCT Pub. No.: WO2009/106685

PCT Pub. Date: Sep. 3, 2009

(65) Prior Publication Data

US 2011/0004435 A1 Jan. 6, 2011

(30) Foreign Application Priority Data

Feb. 28, 2008 (FI) ..... 20080164
Mar. 26, 2008 (FI) ..... 20080236

(51) Int. Cl.
*G08B 13/10* (2006.01)

(52) U.S. Cl.
USPC ..... 702/150; 702/179; 702/138; 382/115; 382/103; 382/209; 340/572.1; 340/425.5; 340/573.1; 244/3.1

(58) Field of Classification Search ..... 702/138, 702/179, 150; 382/115, 103, 143, 209; 340/572.1, 340/425.5, 573.1; 244/3.1
See application file for complete search history.

(56) References Cited

U.S. PATENT DOCUMENTS

| | | | | |
|---|---|---|---|---|
| 4,888,581 | A | 12/1989 | Guscott | |
| 6,515,586 | B1 | 2/2003 | Wymore | |
| 6,882,959 | B2 * | 4/2005 | Rui et al. | 702/179 |
| 6,954,148 | B2 * | 10/2005 | Pulkkinen et al. | 340/572.1 |
| 7,035,764 | B2 * | 4/2006 | Rui et al. | 702/179 |
| 7,394,046 | B2 * | 7/2008 | Olsson et al. | 244/3.1 |
| 7,617,167 | B2 * | 11/2009 | Griffis et al. | 706/45 |
| 7,684,590 | B2 * | 3/2010 | Kampchen et al. | 382/103 |
| 7,944,468 | B2 * | 5/2011 | Hoffman et al. | 348/143 |
| 8,077,981 | B2 * | 12/2011 | Elangovan et al. | 382/209 |
| 8,244,495 | B2 * | 8/2012 | Goldbach et al. | 702/150 |
| 2003/0227386 | A1 * | 12/2003 | Pulkkinen et al. | 340/573.1 |
| 2004/0220769 | A1 * | 11/2004 | Rui et al. | 702/179 |

(Continued)

*Primary Examiner* — Carol Tsai
(74) *Attorney, Agent, or Firm* — Birch, Stewart, Kolasch & Birch, LLP

(57) ABSTRACT

The system according to the invention interprets sensor observations by tracking objects and by collecting information about the objects by means of the tracking and by using this information for affirming events linked to the objects and in producing information describing the events. The system detects events according the conditions defined for them, on the basis of sensor observations. The conditions can relate to the essence of the objects, e.g. to the strength of the observations linked to the object, to the size and/or shape of the object, to a temporal change of essence and to movement. The event conditions used by the system can comprise conditions applying to the location of the object. The system according to the invention can be used e.g. for detecting the falling, the getting out of bed, the arrival in a space or the exit from it of a person by tracking an object with a dense sensor field, and for producing event information about the treatment or safety of the person for delivering to the person providing care.

16 Claims, 9 Drawing Sheets

U.S. PATENT DOCUMENTS

Figure 1:
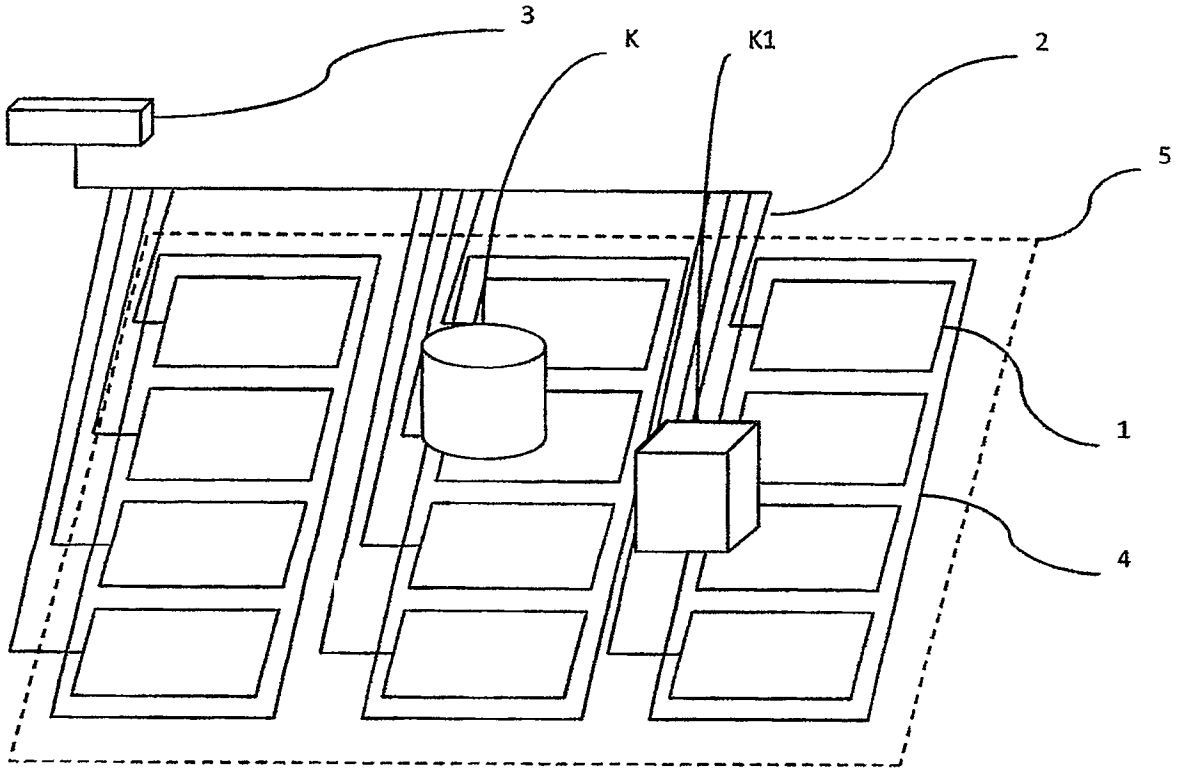

2005/0052533 A1* 3/2005 Ito et al. ..... 348/169
2005/0114079 A1* 5/2005 Rui et al. ..... 702/179
2006/0171570 A1* 8/2006 Brendley et al. ..... 382/115
2007/0011722 A1* 1/2007 Hoffman et al. ..... 726/3
2008/0128546 A1* 6/2008 Olsson et al. ..... 244/3.1
2008/0136813 A1* 6/2008 Goldbach et al. ..... 345/419
2010/0007476 A1* 1/2010 Klotz et al. ..... 340/425.5

* cited by examiner

METHOD AND SYSTEM FOR DETECTING EVENTS

FIELD OF THE INVENTION

The object of this invention is a method and a system for tracking objects that uses a dense sensor field.

PRIOR ART

In prior-art solutions the presence, location and movement of people, animals, objects and devices are detected using microwave radars or ultrasound radars, infrared detectors, video imaging and analysis of it, near-field sensors installed in the floor, pressure sensors or separate touch sensors used on top of the floor covering.

In prior-art solutions detection of an object is based on making an observation that covers a short period of time, or that is instantaneous, with detectors or sensors. The area to be monitored is covered with detectors or sensors, or a sensor or detector is disposed in a local object, and each observation produced by the sensor or detector that is stronger than a threshold value and exceeds a set limit for its duration is used to affirm an event of the object of interest. In some cases the condition for affirming an event can be an observation applying to a part of the sector of some detector or of a corresponding monitored area. Solutions in practice are e.g. the use of an infrared detector or a microwave radar for detecting a person arriving in a space or the use of a pressure sensor mat for detecting a patient getting out of bed. The problems of prior art solutions are the difficulty of making the correct interpretations that adequately contain the necessary information using sensor observations that are instantaneous or of very short duration. The unreliability and inaccuracy of information reduces its value. An example of the unreliability and inaccuracy of event information is alarm information applying to getting out of bed given by a sensor mat next to the bed in a situation in which another person has arrived next to the bed.

The problem of camera surveillance is that it typically requires that a person interprets the surveillance images in order for events that require actions, or that otherwise need detecting, to be detected. The automated interpretation of images requires expensive equipment, and often the interpretation of images anyway requires that a person makes an interpretation in order to achieve adequate accuracy of the content of the event information and reliability of the information.

Some solutions also present surveillance solutions wherein an RFID identifier is fixed to the moving objects in the space to be monitored. The problem with these solutions is that only those objects to which an identifier has been fixed are detected. An active identifier provided with a power source is used in some solutions, a problem in which is the duration of the power source, because typically there are very many excitation transmitters that activate the identifier in the space to be monitored and the identifier correspondingly activates many times.

The use of a dense near-field sensor field in detecting presence is presented in U.S. Pat. No. 6,407,556B1, among others.

The use of pressure sensors to detect presence or movement is presented in U.S. Pat. No. 4,888,581A1, among others.

There are many prior-art solutions for the tracking of a number of objects (multitarget tracking). The linking of the type of the object to the object as a part of the tracking of the object is presented in U.S. Pat. No. 6,278,401 B1, among others.

The use of a near-field sensor that is installed in the floor and measures an electrical connection for making observations is presented in application W02005020171A1, among others.

One problem of prior-art solutions that produce event information is the great need for processing power required to identify an object and the events linked to the object. For example, the identification of outlines on the basis of a video image can require e.g. hundreds of kilobytes per second of real-time analysis. On the other hand, one problem is also the relatively high amount of errors that occur in identification. More particularly, reliable identification of events linked to the tracked object by utilizing prior-art solutions has proven to consume resources and to be prone to operational error.

In prior-art solutions, the inflexibility of the solution is a problem when using detectors installed in locations, or targeted at them, as the object of the monitoring. When the use of the space to be monitored changes, and the event that is the object of the monitoring moves to a new location, or the event changes to another, the location and/or the targeting of the detectors must be changed. Changes require actions that during the lifecycle of the solution incur substantial modification costs and equipment costs, and also restrict the use of the spaces during the modification process.

BRIEF DESCRIPTION OF THE INVENTION

The invention presents a system and a method, based on a dense sensor field, for tracking objects, which detects objects by tracking and events linked to the objects and to the space to be monitored by using predefined event conditions, and produces event information describing these events for use immediately or later.

The system according to the invention comprises a sensor field comprising two or more sensors in the vicinity of the object that are suited to the detective measurement of touch and/or pressure, measuring electronics that produces sensor observations by means of sensors, and a data processing apparatus, suited to processing sensor observations, comprising a processor and a memory. The system is characterized in that the data processing apparatus is arranged to detect the object to be tracked and to detect an event linked to the object on the basis of one or more sensor observations.

The processor of the system and the data processing apparatus, which comprises a memory, can be arranged to track an object by means of sensor observations.

The sensor observations used to detect or track an object and/or to identify an event linked to the object can be sequential in time.

The sensor field can comprise on average e.g. 4, 9 or 49 sensors per square meter. The strength of the sensor observations can vary e.g. according to the size, distance and/or material of the object causing the sensor observation.

The sensors of the system can be arranged to produce sensor observations e.g. at intervals of 0.01 or 0.1 seconds.

The sensor observation can be located e.g. on the basis of the location of the sensor that made the observation.

The system can detect an object e.g. on the basis of the strength of the observations and on the basis of their interpositioning. The system can track an object e.g. on the basis of a change in the location of the observations linked to it. In one preferred embodiment of the invention the data processing apparatus can process observations e.g. such that the system detects sensor observations linked to an object that are measured at different moments of time and collected for a period of at most five minutes by processing events linked to the object. An event linked to the object can be e.g. a change in status of the object, e.g. a movement in the sensor field in the space being monitored, an arrival into this space, an exit from the space, stopping or falling. A change in status of the object can be detected e.g. on the basis of the extent of the observations caused by the object, the shape of the outline formed in the sensor field from the observations and/or the strength of one or more sensor observations. Also the speed of the change of status of the object can be utilized in identifying an event.

The system can include an object in the tracking by recording at least one status information about the object, which status information describes the location or other possibly changing characteristic of the object at a certain moment of time. The system can estimate the probable new values of the status information of an object on the basis of the values recorded earlier and on the basis of the time that has passed from the moment in time they represent. In addition, tracking an object can comprise linking sensor observations to the object. The system can produce an association, which describes the linking of sensor observations to the tracked objects, and which is formed such that it describes how the tracked objects probably caused the sensor observations. The system can produce this association such that the system uses estimates, applying to the moment in time of the sensor observations, about the status information of the tracked objects and e.g. uses information about the estimated location of each object. The system can e.g. select the linking of an observation from the objects to be tracked to an object or to those objects which, on the basis of the status information, representing the moment of observation and estimated by the system, and on the basis of the estimate of the system applying to the creation of the observations, most probably influenced the observation in question. The system can update the status information of an object to be tracked by recording in it new or changed information on the basis of the observations linked to the object. Information applying to numerous moments of time can be recorded in the status information of an object. The content of the status information of an object can be e.g. the location, speed, direction, acceleration, size, shape, extent, density, way of moving of the object and/or other characteristic of the object inferred on the basis of observations. For example, the way of moving of an object can be recorded in the status information of the object on the basis of the shape of the outline formed by the observations linked to the object. For example, in a case in which the object to be tracked is a person, the way of moving can be recorded e.g. according to whether the sensor observations are suited to being caused by a person progressing by walking, running or crawling.

The system can process sensor observations such that it estimates the probability that the sensor observation of one or more certain moments of time are caused by an object that is not included in the tracking. The system can compare this probability to the probability with which the same observation is caused by an object included in the tracking. On the basis of the comparison and of the observations that are their basis of them, the system can include a new object detected in this way in the tracking.

The strength of the sensor observation or sensor observations linked to an object can be used to locate the position of the object or for inferring, recording and/or updating other information applying to the object.

The system can identify an event to be linked to an object on the basis of the sensor observations of one moment of time or of different moments of time, and/or on the basis of the information applying to one or more objects describing one moment of time or a number of moments of time. The system can use one or more event conditions known by the system for identifying an event. The system can compare information formed from sensor observations to an event condition or to event conditions in order to identify an event.

The system according to the invention can further comprise means for recording event conditions.

An event condition can comprise e.g. a condition or conditions applying to the presence, location, movement, shape, size or other information describing a characteristic, feature or status detectable with sensor observations or based on sensor observations. An event condition can also comprise a combination of conditions for the information describing more than one object. Furthermore, an event condition can comprise a combination of conditions for information describing a number of objects.

An event condition can be e.g. such that the individual conditions that it contains are fulfilled when the system compares them to a certain type of information recorded in the tracking of a person. An event condition can be e.g. such that its conditions are fulfilled when it is compared to information which is recorded e.g. when a person arrives in a space, changes walking to running, falls, gets out of bed, exits the space, changes to become undetectable with the sensors or when two people meet, a person picks an item or leaves his/her traces on an item. The content of an event condition can be e.g. a change in the essence of the object. An event condition can e.g. be such that it is fulfilled as a consequence of the types of observations that are produced when an item brought into the space starts to melt or to leak liquid. The content of an event condition can also be e.g. conditions applying to the location and speed of one object that are fulfilled when the speed of the object exceeds a given limit value when the object is located in a certain area. This kind of event condition is suited to detecting running in an area in which it is not permitted for reasons of safety.

The system can use a combination of conditions as an event condition, which comprises a number of conditions applying to the object. An event condition can be e.g. a combination of conditions applying to two objects, which is implemented if the speeds of and the distance between the objects fall below given limit values for at least a set length of time. This kind of event condition is suited e.g. for detecting money exchange or drug dealing in a space that is intended for passing through.

The system can further comprise means for identifying the type of a detected and/or tracked object by comparing the sensor observations and the information about the detected or tracked object to one or more identification profiles. An identification profile can comprise information about e.g. the area, number, strength of the sensor observations typically caused by an object or about the typical speed of movement of an object in the sensor field. The system can further comprise means for recording and reporting an object as an object of an unknown type. An object of an unknown type can be identified e.g. manually and information about its type can be recorded in the information of the object.

The system according to some embodiments of the invention can comprise ways and means for identifying an object with external means suited to the purpose, e.g. with an RFID reader. The system can receive information delivered by the external means e.g. about the identity and estimated location of some object, and the estimated point in time when the object was in this location. Further, the system can produce and deliver an identification request for implementing the tracking of some object, on the basis of the location of the object to be tracked and the known local coverage of the external means used to identify the object, to the aforementioned external means and receive information about the identity of the object delivered by the external means as a response to this request. The system can compare information received from the external means, and known information about the characteristics of an object on the basis of it, to the information recorded in tracking the objects and e.g., when the sets of location information match, the system can record the external identity of the object, and/or the type of the object known on the basis of it, in the information of a certain object to be tracked.

The system according to some embodiments of the invention can comprise one or more event conditions, which comprise a condition or conditions applying to the type or the identity of an object.

The system according to some embodiments of the invention can process sensor observations such that when processing the observations, and when tracking the objects, information is used that describes the delimitation of the space to be monitored with the sensor field, e.g. according to the doors, walls and corresponding factors, observation needs that differ from each other of the different areas of the space, or other factors that affect the use and observation need of the space and the furniture located in the space.

The system according to some embodiments of the invention can process sensor observations such that when processing the observations, and when tracking the objects, information is used when linking the sensor observations to a new object that describes the characteristics of the space to be monitored with the sensor field, which can increase or decrease the probability of the appearance of a new object compared to what it is elsewhere in the space to be monitored.

The system according to some embodiments of the invention can process sensor observations such that information for updating the information applying to the status of the objects to be tracked is used in the processing, which information describes the characteristics of the space to be monitored with the sensor field, which characteristics affect the supply of sensor observations about the objects. The system can use information applying to e.g. the location of furniture as this type of information. The system can e.g. deem that an object is recorded as being located in a certain shadow area until a new observation about the object is obtained as a result of the exiting from the shadow.

The system according to some embodiments of the invention can in tracking objects use information which describes areas that delimit the space to be monitored, which are closed from the standpoint of movement of the object, from where the object is not assumed to exit otherwise than by returning to the monitored space. The system can use information about e.g. a cupboard, bathroom or balcony as this type of information The system can e.g. record a person as being on a balcony as a result of the observations received about the person indicating that the person has moved to the balcony along a route leading there via a door opening.

The means that some embodiments of the system according to the invention comprise for processing sensor observations can comprise the information describing the location, size, position, movement components of the plane of the sensor field, distance from the plane of the sensor field, a certain physical characteristic of an object, other corresponding information, information about the speed of change of the status or of a characteristic of an object, or a combination of these information sets, being used as information applying to the status of the objects.

The means that some embodiments of the system according to the invention comprise for processing sensor observations can comprise the characteristics of an object being inferred on the basis of the sensor observations linked to an object. The characteristics that can be inferred can be e.g. the extent, shape, height, composition, distribution of mass, ability to move, or distribution probability of the object, that is projected to the sensor field.

The invention also relates to a method that can be implemented with the systems according to the different embodiments of the invention.

An advantage of the invention with respect to prior-art solutions is e.g. that with the method and the system it is possible to produce appropriate information about the events of the space to be monitored in a format that is well suited to the use of people and equipment. The method and the system identify events according to given event conditions with great accuracy such that event information with the correct content that describes an event is formed about exactly the desired events of the target space. The method and system according to the invention allow the detection and identification of events according to the defined use of each room such that event information is obtained about exactly those events about for information is needed. Furthermore, accuracy of the identification of events as well as correctness of the content of event information is achieved that are better than what can be achieved with economically comparable prior-art solutions. An advantage of the invention with respect to prior-art solutions is the high utility value of the observation information produced by processing the sensor observations and/or of the event information produced on the basis of it compared to the equipment resources required for producing and analyzing the information, e.g. to the amount of processing capacity or of memory.

An advantage of the method according to the invention is that by processing sensor observations measured at different moments of time, the necessary event information is produced with a lesser amount of sensors per unit of area than what is required in prior-art solutions to produce information that is just as accurate and reliable. The "resolution" of the sensor field can be set in different embodiments to be suited to the usage purpose. In the sensor field in some embodiments the extent of an individual sensor as well as the distance between sensors can also be arranged to be big, e.g. to tens of centimeters. In some other embodiments of the invention the distance between the sensors can be small, e.g. a few centimeters, in which case more observation data is obtained. The observation data produced by the sensor field can, in addition to the size of the object to be detected, also depend on its other properties, such as e.g. the material. The system can use a large amount of the observations applicable to the recent history of the object that is linked to the object by means of the tracking of the objects for detecting an event linked to an object. One advantage of this method compared to prior-art methods is that the observations obtainable at each moment of time do not necessarily need to be as accurate as when using a method that uses a short or instantaneous observation, which makes possible the use of a simpler sensor field and possibly one that is less expensive in terms of costs.

An advantage of the invention with respect to prior-art solutions is also better flexibility, because when the use of the space to be monitored changes, the physical system does not require changes. With a new placement of events that are an object of interest, e.g. when changing the locations of furniture or walls, the system can be adapted to the situation by changing the event conditions in a manner that corresponds to the change in the use of the spaces.

One possible advantage of the method and system according to the invention is that its technical simplicity and the economic inexpensiveness resulting from it makes possible an improvement in safety and operational efficiency by monitoring also the types of spaces the monitoring of which is not economically or technically reasonable with prior-art solutions, and by producing event information in these spaces about moving objects in different spaces that can be used for living, staying, production, leisure, retailing or other purposes.

Further, one advantage of the method and the system according to the invention can be that it detects and produces information about the falling of a person such that it is possible for the recipients of the information to quickly provide help to prevent and to mitigate the injuries of injured persons caused by falls. In the monitoring implemented with prior-art solutions the corresponding information is more unreliable, which reduces the utility value of the information owing to the cost, trouble and other inconvenience caused by "false alerts".

Yet another advantage of the method and the system according to the invention with respect to prior-art solutions can be that the means for detecting the identity of an object used in connection with it needs to cover only certain points of the possible routes of objects. When an object passes via this type of point the system receives information about its identity, and when the object moves in the area to be monitored its identity is known by the system as a part of the information used in tracking the object.

An advantage of the system and method with respect to prior-art solutions is that determination of the identity of an object based on e.g. the reading of an RFID identifier can be connected to the system according to the invention such that the excitation used by the external means in the reading is sent according to the location of the object to be identified, which causes the activation of only the identifiers located in the desired area so that the received volume of responses sent by the identifiers is reduced and there is no need in the receiving arrangements to take into account responses about locating the identifiers sent, so that the arrangement can be implemented with a small amount of receiving apparatuses. Furthermore, other advantages include the fact that RFID reader collisions and RFID tag collisions are avoided, and no other solutions are needed for these.

DETAILED DESCRIPTION OF THE INVENTION

In the following the invention will be described in more detail with reference to the embodiments presented as examples and to the attached drawings, wherein FIG. 1 presents one system according to the invention.

Figure 2:
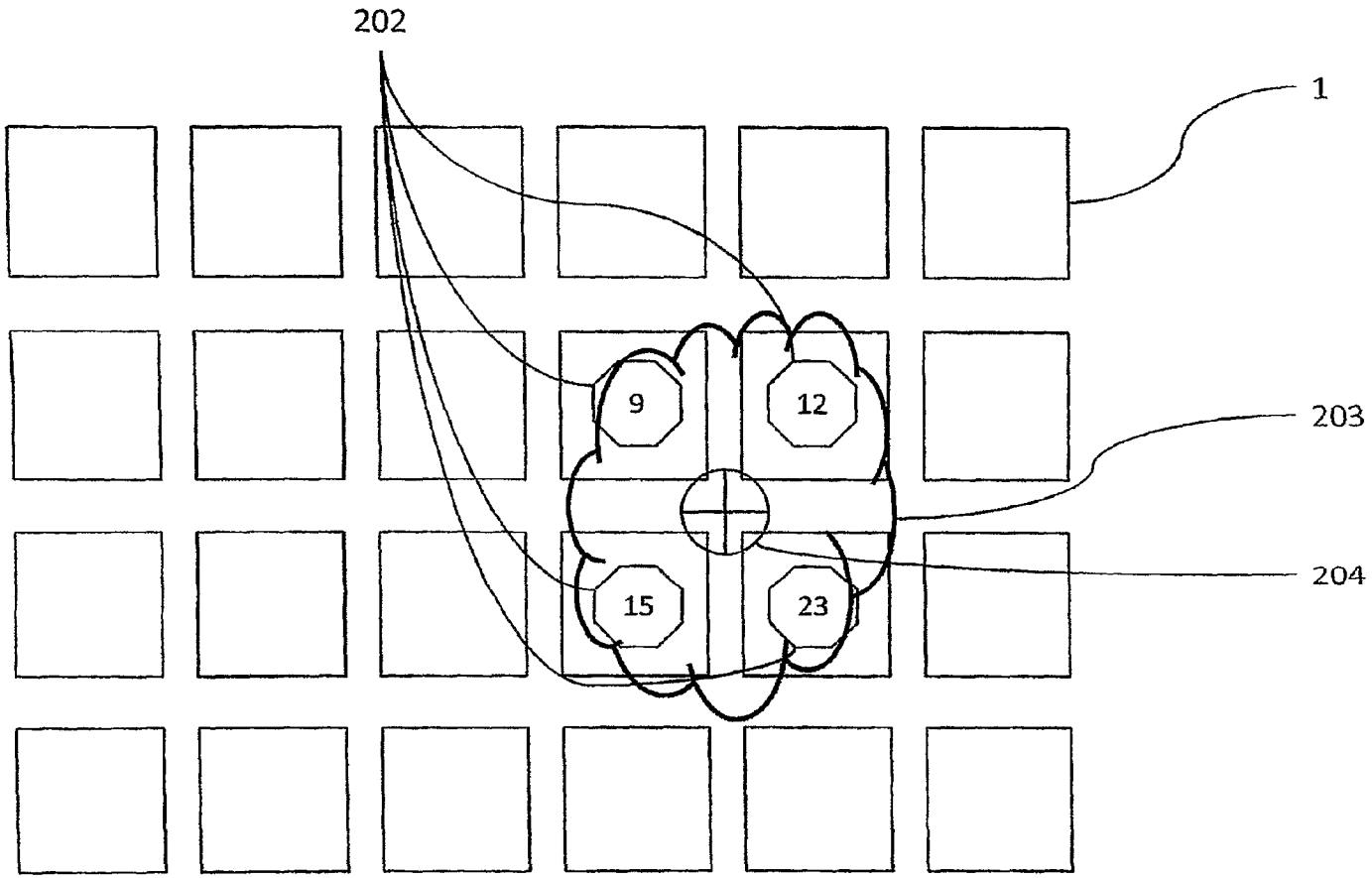

FIG. 2 presents by way of example the linking of sensor observations to the object according to the invention.

Figure 3:
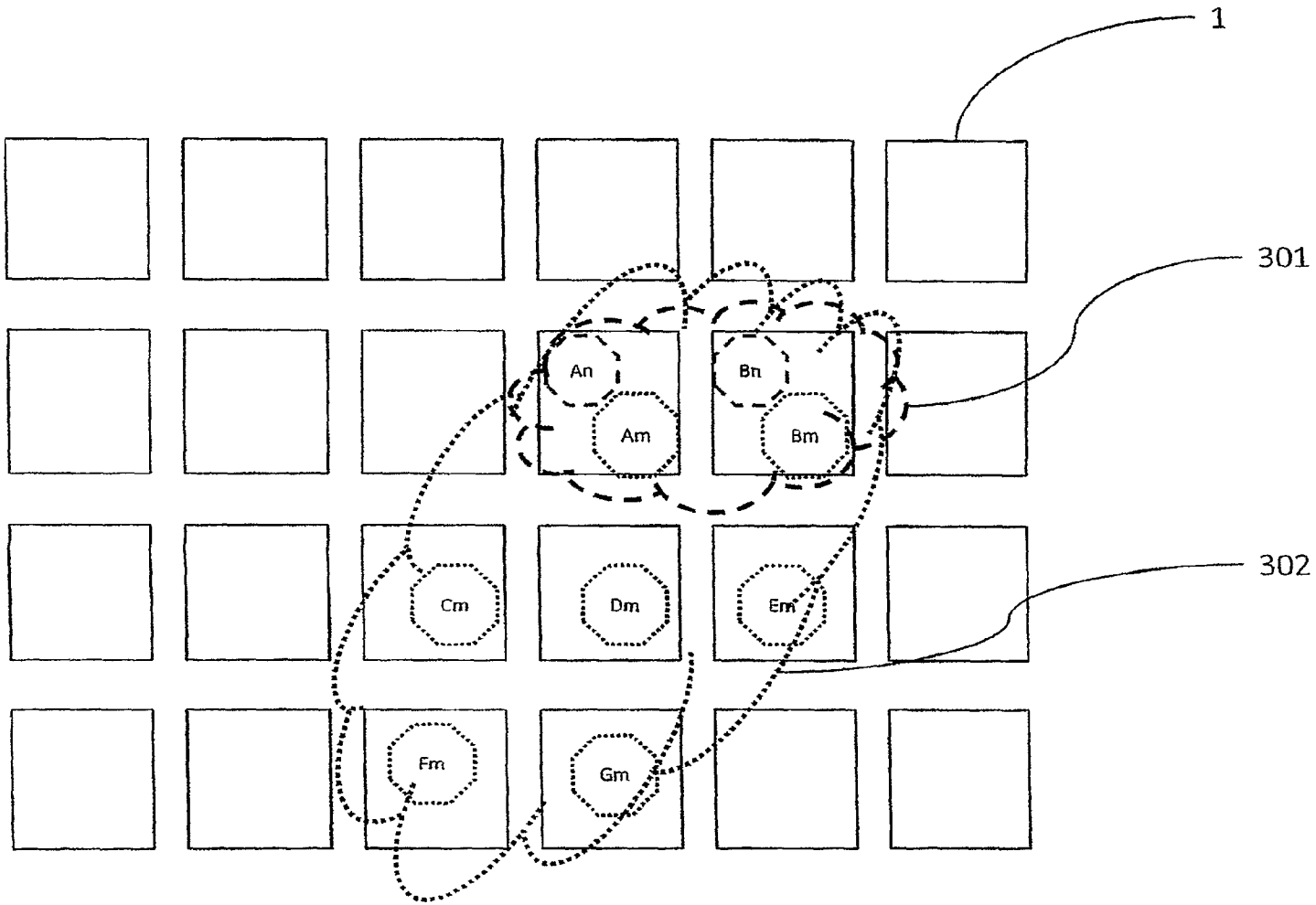

FIG. 3 presents an example of the sensor observations produced by a person falling and of the tracking of an object in a system according to one embodiment of the invention.

Figure 4:
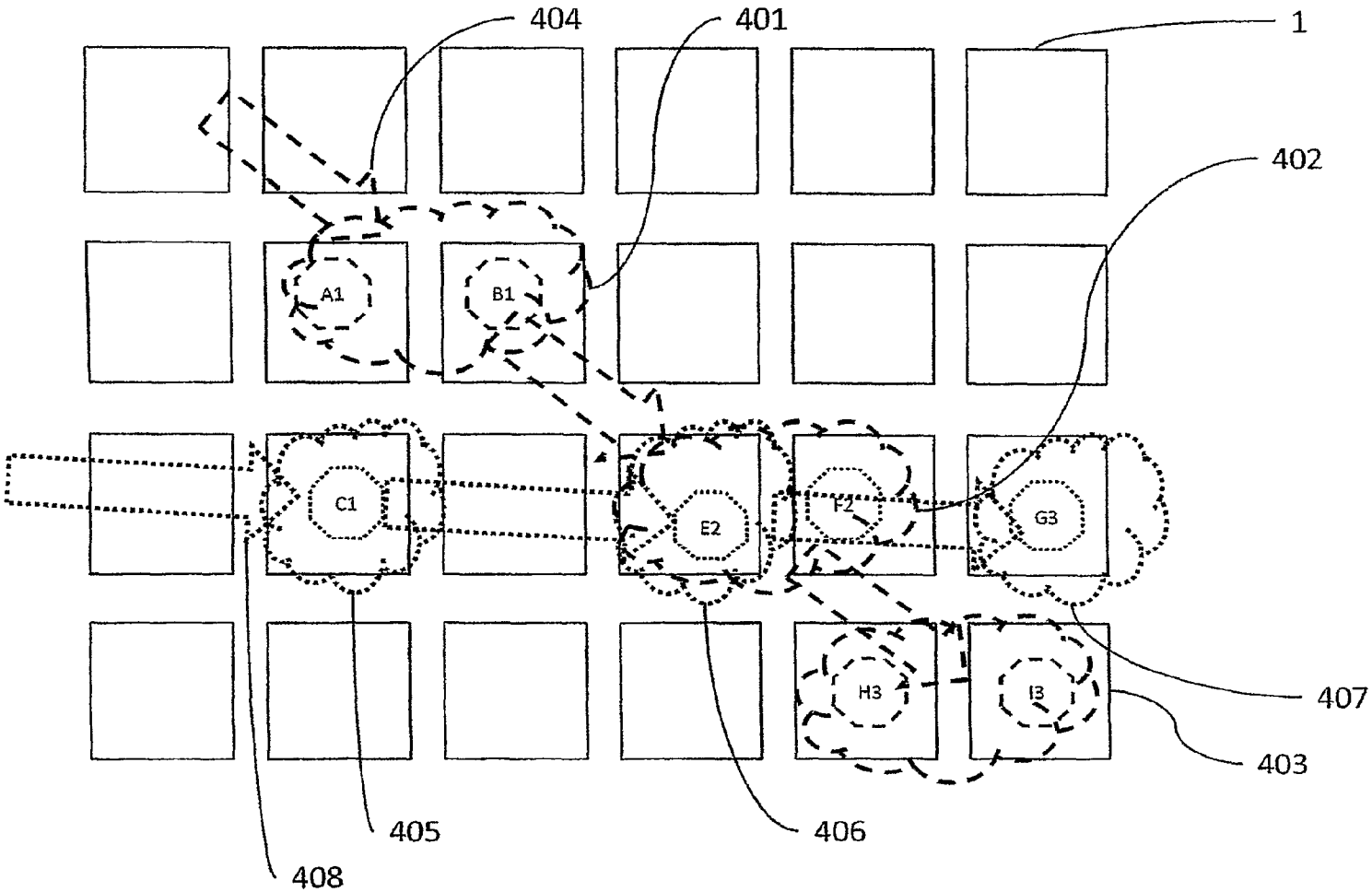

FIG. 4 presents the observations produced by two objects approaching and meeting each other, and the processing of these in the system according to one embodiment of the invention.

Figure 5:
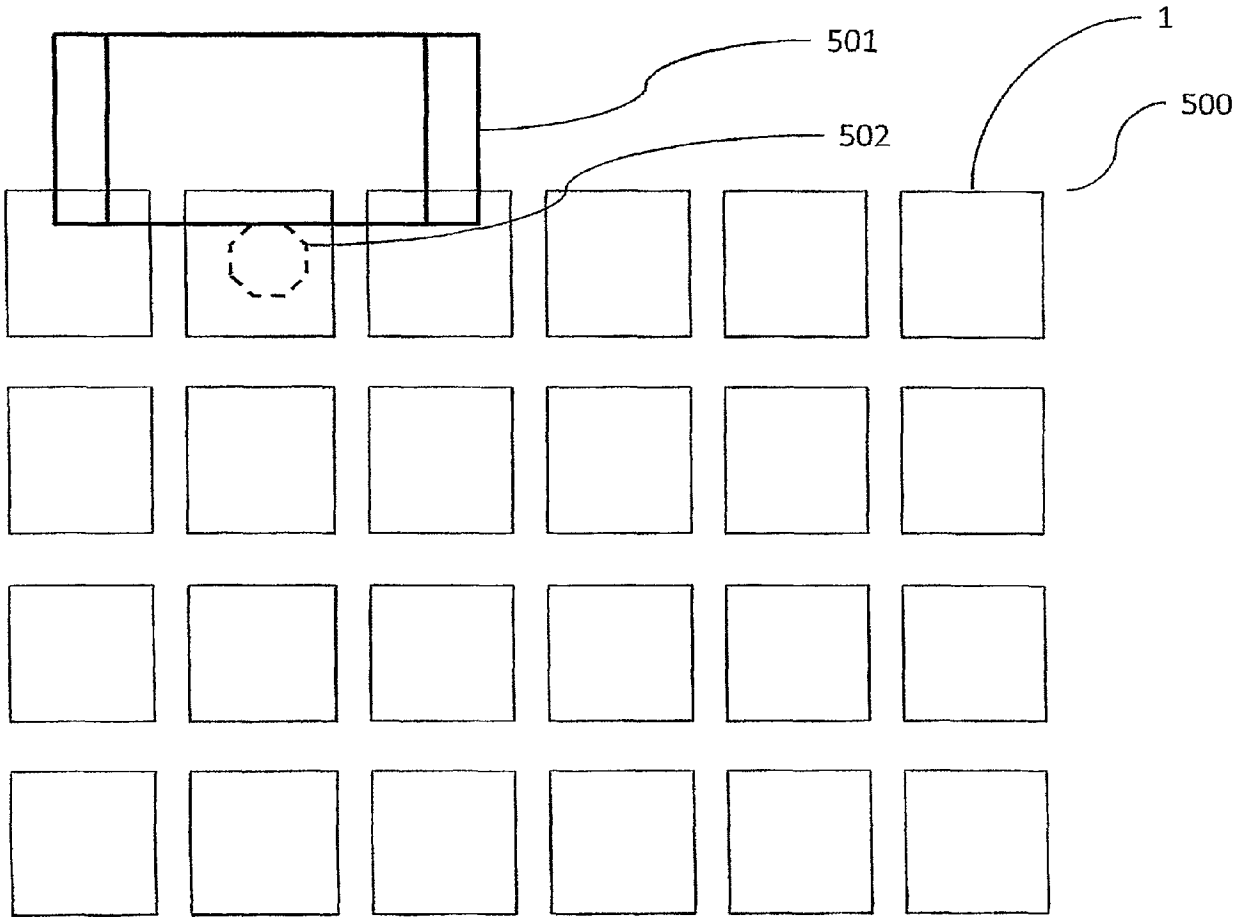

FIG. 5 presents the sensor observations produced by a person getting out of bed in the system according to one embodiment of the invention.

Figure 6:
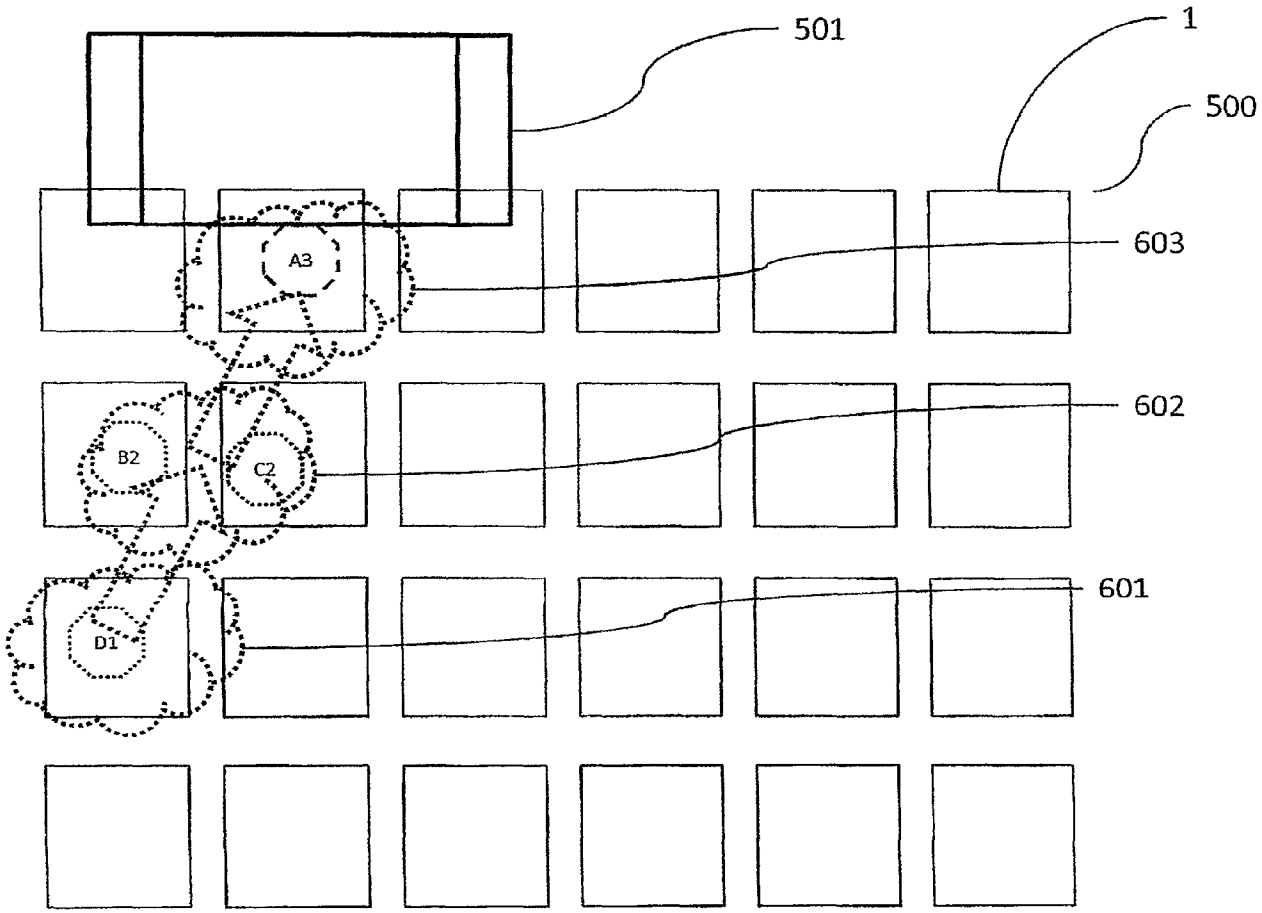

FIG. 6 presents the sensor observations produced an object moving to beside the bed at sequential moments of time and the processing of the observations in the system according to one embodiment of the invention.

Figure 7:
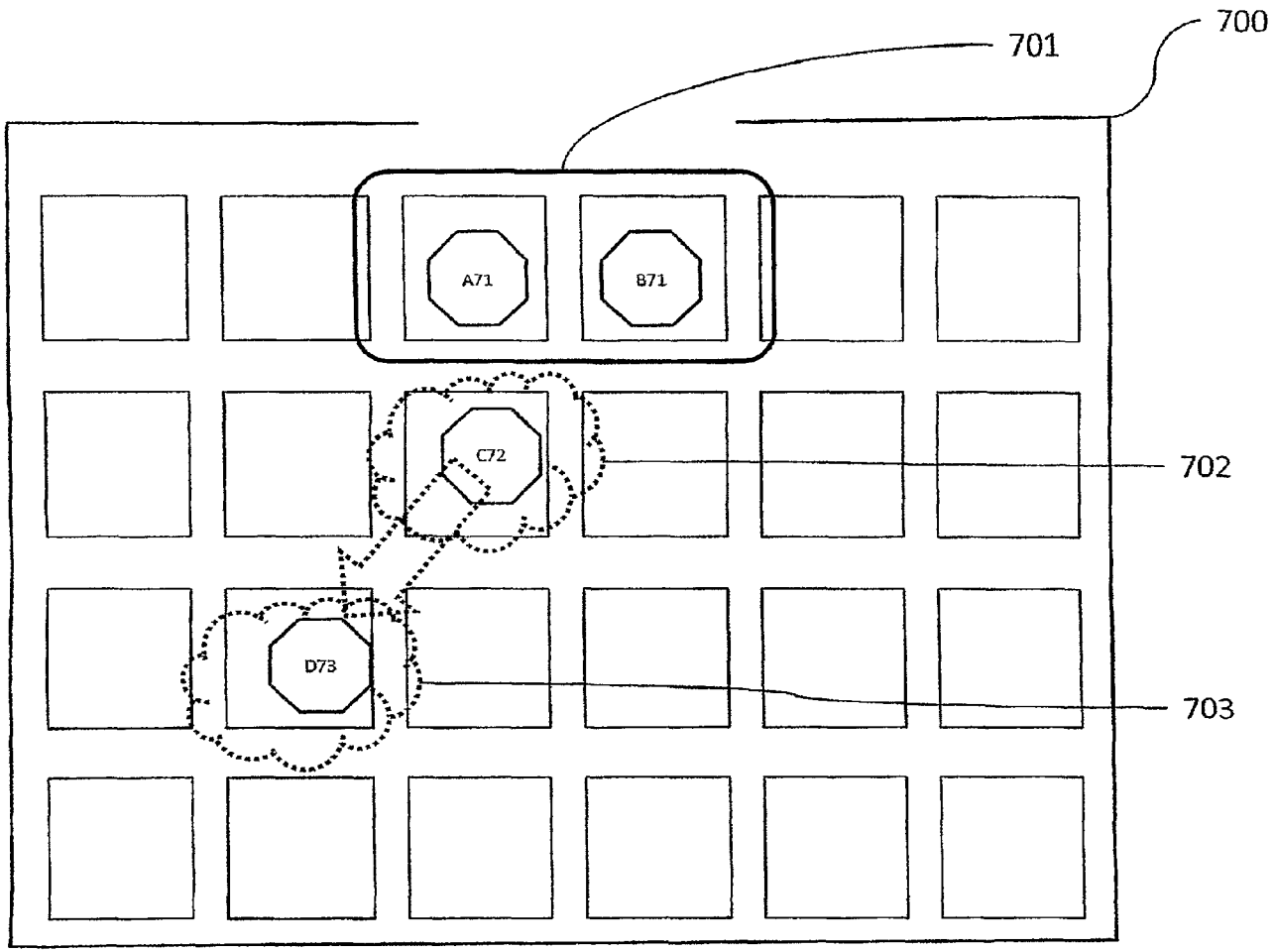

FIG. 7 presents the production of event information on the basis of the arrival area in the system according to one embodiment of the invention.

Figure 8:
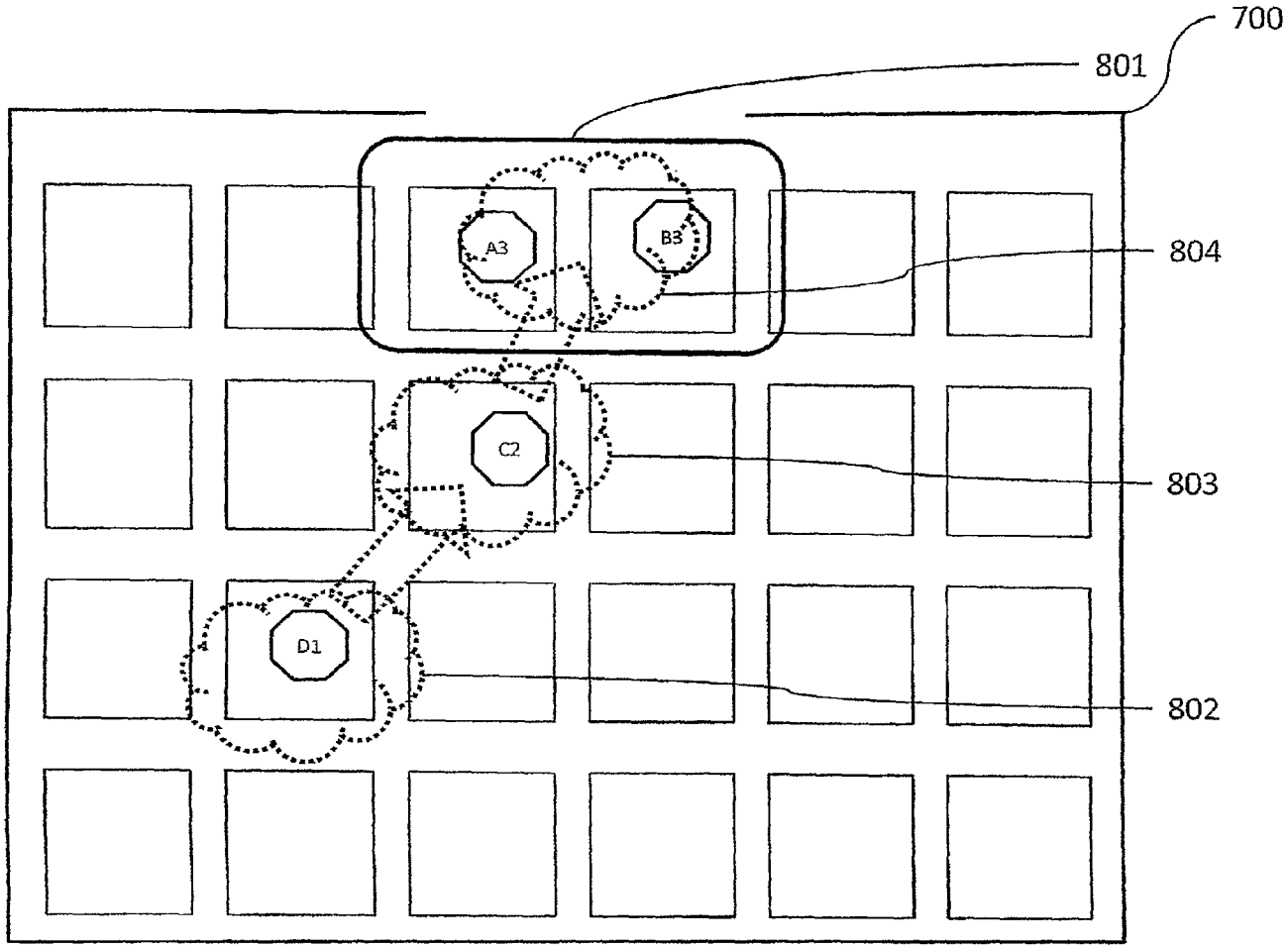

FIG. 8 presents the production of event information applying to exiting a space on the basis of the tracking of the object and on the basis of the exit area in the system according to one embodiment of the invention.

Figure 9:
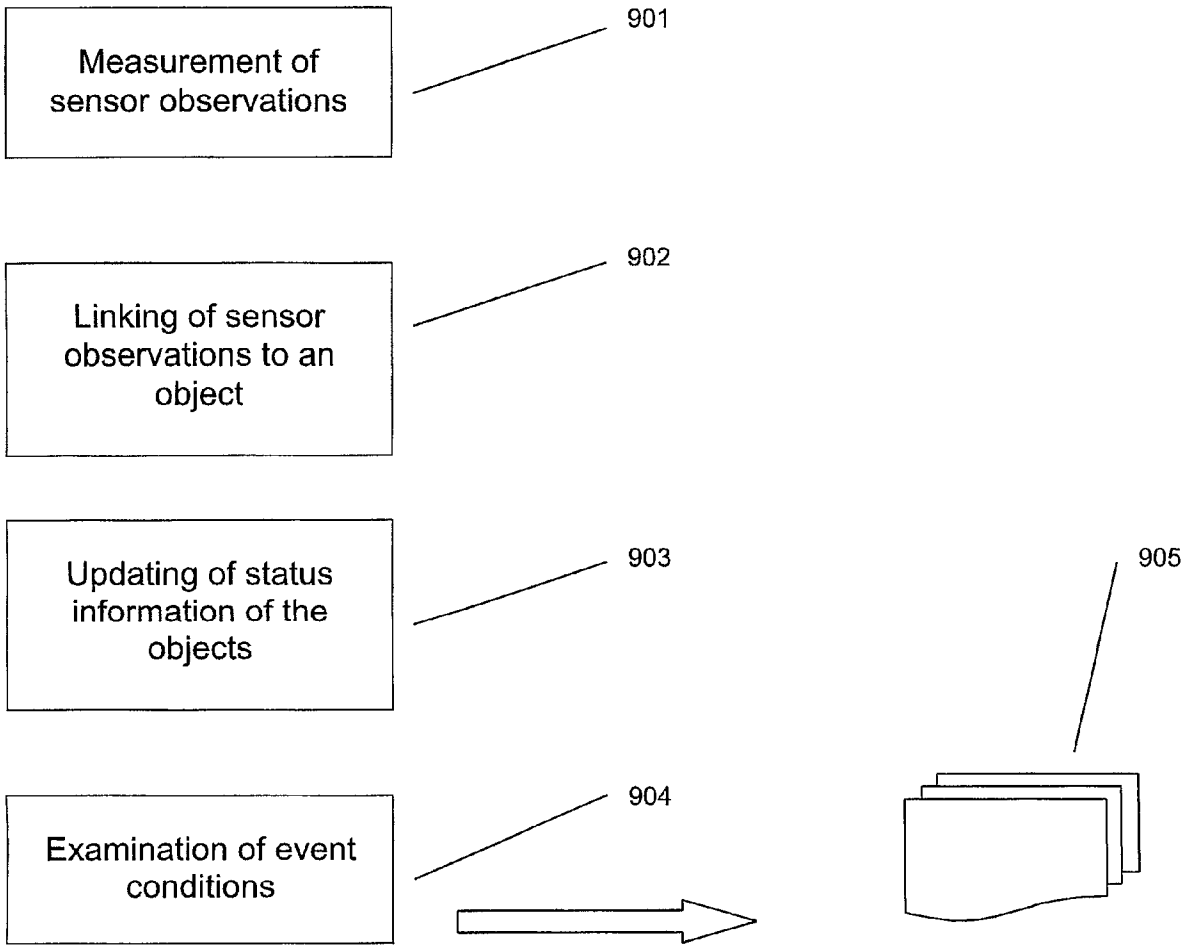

FIG. 9 presents a diagrammatic example of the phases of the processing of sensor observations and of the production of event information in the system according to one embodiment of the invention.

FIG. 1 presents a system according to one embodiment of the invention, which comprises a sensor field (5), comprising sensors (1) used for measuring an electromagnetic near field, which is installed in the floor. The sensors are connected to measuring electronics (3) with sensor conductors (2). The sensors are planar thin sheets or films, which are disposed in a mat-like structure (4) electrically isolated from the environment. The mat-like structure is disposed under the surface material in the structure of the floor. The surface material of the floor is not shown in the figure. The system is used for monitoring a space delimited to the sensor field and for detecting objects (K, K1) that are in the proximity of the sensor field or are moving. The placement of the sensors in the sensor field is such that the changes in the sensor observations caused by the objects intended to be detected are sufficient for implementing tracking of the objects. The sensitivity of the sensors and the distance between the sensors is such that the object intended to be detected and tracked cannot stop in the type of location and position in which it does not cause an adequately large change in the sensor observation from the viewpoint of tracking.

FIG. 2 presents some information about a detected object produced by the processing of the sensor observations (202) made by means of the sensors (1) of the measuring electronics according to the embodiment of the invention according to FIG. 1. The processing of the sensor observations has linked the observations (202) to an object and updated the information describing the status of the object (status information). The object and its status information are presented in FIG. 2 as the position (204) of the object and as an outline (203) that presents the size and shape of the object. In FIG. 2 there is a numerical value inside the octagon representing each sensor observation, which describes the strength of the signal of the sensor observation at the moment of time in question.

FIG. 3 presents the observations (An, Bn) measured at the time Tn, and the observations (Am, Bm, . . . Gm) measured at the time Tm, in a sensor field comprising sensors (1) of a solution according to one embodiment of the invention. The octagons representing the observations of two different moments of time are presented in connection with the sensor at different points for technical drawing reasons. The position of the observations of each sensor at different moments of time is of no difference from the viewpoint of the system. On the basis of the observations of the time Tn and the tracking of the object preceding this, the system has information about the object, of which the location, shape and size are presented as an outline (301). The system updates the information of the object as a result of the processing of the observations of the time Tm. Information about the object after updating is presented as an outline (302). Information about the object at the time Tm, the change in the information with respect to the information of the time Tn and the length of time that has passed between these times fulfill the event conditions known by the system that are set for a falling event. The system produces event information about the falling event on the basis of the processing of the observations of the time Tm.

In one preferred embodiment of the invention the extent of the observations that express the proximity of some body part by their strength that are linked to an object are used as an event condition of a falling event, expressed as the area covered by the observations and as the largest distance between the observations, as a change in the speed of the extent, and as the subsequent permanence of the location and strength. Observations, which change at a determined speed from observations corresponding to a vertical attitude to observations corresponding to a fallen person, are interpreted according to the condition as falling.

FIG. 4 presents the processing of measured sensor observations according to one embodiment of the invention in the case of two meeting objects. The figure presents the processing of measured sensor observations in a sensor field comprising sensors (1) at the consecutive moments of time T1, T2 and T3. At the time T1 the observations (A1) and (B1) are linked to the first object, according to the information of which the outline is (401), and the second observation (C1) of the same moment of time, which is linked to the second object (405). The processing of sensor observations has produced information about the states of motion of the objects, which is presented as arrows (404, 408), on the basis of the previously calculated locations and the state of motion of the observations and the objects of the time T1. At the time T2 the system measures the observations (E2) and (F2). The system links these observations to the objects using the status information of the objects. The system links the observation (E2) to a second object, the outline and location (406) of which according to the status information produced by the processing of the observations at the time T2 is presented in the figure. Correspondingly the system links the observations (E2) and (F2) to the first object (401). The outline and location (402) according to the information produced by the processing of the observations at the time T2 that are linked to this object are also presented in the figure. The system correspondingly processes the observations (G3, H3 and I3) of the time T3, which produces new status information for the objects, the outlines according to which for the first (403) and the second (407) object are presented in the figure. The result of the processing of the observations of the time T2 and T3 and more particularly the status information of the objects contained in these results correspond with a good degree of accuracy to the movement of the actual objects, because the system has used the earlier status information of the objects in tracking the objects and in updating the status information of the objects. On the basis of the status information of the objects the evaluation of the fulfillment of the event conditions made by the system avoids the production of incorrect information e.g. on the basis of the observations of the time T3.

FIG. 5 presents an observation (502) measured with the sensor field (500) comprising sensors (1) according to one embodiment of the invention, the location of which observation is next to a bed (501) disposed in a space monitored with the sensor field. The system according to this embodiment of the invention processes the sensor observations and links the observation (502) to a new object using information about the relative locations of the bed (501) and the observation (502), as well as information about the fact that the appearance of a new object in the vicinity of the bed (501) is possible. Further the system immediately produces event information on the basis of the observation (502) based on the event condition set for the system, according to which event condition immediate event information about an object appearing in the vicinity of the bed (501) must be produced.

In one preferred embodiment of the invention the appearance conditions of different types of objects are used for detecting the appearance of new objects. The appearance conditions guide the operation of the system by setting sensor observations for each object type that interpret that an object has appeared. The appearance conditions are compiled such that on the basis of them the system links as few sensor observations as possible to a new object that has appeared, and such that this is not done other than when the probability is sufficiently great that the observations are of the type caused by a new object that has appeared. In a situation in which the linking of observations to an object that has appeared is suited to a number of appearance conditions of an object type with only a minor probability of divergence to each other, the alternative object types in question are recorded in the information of the object, and on the basis of observations later linked to the object, when this is justified according to the observations, the object types deemed to be less probable for the object are excluded.

In one preferred embodiment of the invention, the sensor observations linked to an object are used in detecting the properties of the object. The characteristics observed and recorded in the status information of an object can be the extent, shape, height, composition, distribution of mass, ability to move, distribution probability or some other characteristic of the object that is projected to the sensor field, about which there is a need to obtain information. The system processes sensor observations such that some characteristic or some characteristics of the object are determined on the basis of the correlation between the observations linked to an object known by the system and the characteristic, and on the basis of the observation series formed by the observations. The system can process sensor observations such that a correlation model used in detecting the characteristics is formed on the basis of the observation material and the basis of the known characteristics of the objects that caused the observations.

FIG. 6 presents the observation D1 measured at the time T1, the observations (B2, C2) measured at the time T2, and the observation (A3) measured at the time T3 with a sensor field (500) comprising sensors (1) according to one embodiment of the invention. The system according to this embodiment has, on the basis of the observations of the time T1 and on the basis of earlier tracking, updated the status information of the object to be tracked, which is presented in the figure as an outline (601). Correspondingly the system has updated the status information of the object to be tracked according to the processing of the observations of the times T2 and T3, which information is presented in the figure as the outlines (602) and (603). The information relating to the bed (501), which is described in connection with FIG. 5, is set in the system. When processing the observation (A3) the system affirms that the event condition applying to getting out of bed is not fulfilled, because the object arrives in the proximity of the bed from elsewhere in the space to be monitored.

FIG. 7 presents the observations A71 and B71 measured at the time T71, the observation (C72) measured at the time T72, and the observation (D73) measured at the time T73 with a sensor field comprising sensors according to one embodiment of the invention, as well as a structure (700) that delimits the space and an arrival area (701) located in connection with the passage aperture leading to the space. The system according to this embodiment processes the observations made at the time T71, and records that a new object has appeared in the arrival area. After this the processing of the observation (C72) made at the time T2 links this observation to the new object, the status information of which the system produces using the information applying to the observations (A71, B71 and C72) and the arrival area (701). The figure presents an outline (702)

according to the status information of these. After the processing of the observation (D73) of the time T3, the outline according to the status information of the aforementioned new object is in a new location (703).

FIG. 8 presents a space to be monitored with a sensor field comprising sensors according to one embodiment of the invention and the delimitation (700) of the space and the exit area (801) located in connection with the passage opening leading to the space. The system according to this embodiment has processed the observation (D1) made at the time T1 and the observation (C2) made at the time T2 and has correspondingly updated the status information of the object being tracked, the outlines (802 and 803) according to which and according to the same times are presented in the figure. The status information, after the processing of the observations (A3, B3) of the time T3, of the object to be tracked is presented as an outline (804) in the figure. After this no observation is received that could linked to the same object. On the basis of the observations the system inferred that the object that was in the location (802) has moved via the locations (803) and (804) out of the monitored space. The system uses information about changes in the status information of the object, about the exit area (801) and about valid event conditions, and according to the event conditions produces event information applying to an object the has exited the delimited space (700). The event condition used by the system is of the type that the event information is produced without delay, on the basis of which the system produces event information about an object to which sensor observations are no longer linked.

In one preferred embodiment of the invention when linking observations to the objects that are to be tracked, conditions are used that contain information about the characteristics of the space to be monitored, such as about a route leading away from the space, or about a structure or furniture, from the influence of which the object can stop causing sensor observations after moving from its previous location. An example of this type of structure is a stairway leading to the second floor and a high-legged seat is a corresponding example of the furniture.

In one preferred embodiment of the invention when linking observations to the objects that are to be tracked, conditions are used that contain information about the characteristics of the space to be monitored, such as about a route leading away from the space, or about a structure or furniture, after moving into the sphere of influence of which the object stops causing observations and after moving out of the sphere of influence of which the object causes sensor observations. Furthermore, in one embodiment the conditions described above are used as a condition of the disappearance and appearance of a new object.

In one preferred embodiment of the invention when linking observations to the objects to be tracked conditions are used that contain information about the area to be delimited to the space to be monitored, to which there is no other route probably used by the objects than the access via the monitored space. The delimited area can be a bathroom, a balcony, a cupboard or corresponding. In this embodiment information describing the movement of an object deemed to have moved into the delimited area on the basis of the tracking, which is used in linking later sensor observations to the objects, is recorded in the status information. In a case in which a sensor observation is so located on the route leading to the delimited area, on the basis of the sensor observations it is firstly diagnosed that the object that has moved to the delimited area has returned to the monitored area and secondly—if an object has not been recorded as moving to the delimited area, or the observations cannot be linked with sufficient probability to the object that moved there—it is diagnosed that a new object has appeared.

FIG. 9 presents the processing of sensor observations according to one preferred embodiment. Measurement of the sensor observations (901) produces a sensor observation expressed as a numerical value describing the strength of the observation applying to each sensor of the sensor field at a certain moment of time. In the next phase (902) the observations are linked to objects on the basis of the locations of the sensors of the sensor field, the strength of each observation, the status information of the objects and the time that has passed since the previous observations. In this phase some sensor observations are linked to the new object if the observations, taking into account information applying to their strength, location and other observations, the objects to be tracked and the space to be monitored, are deemed to be more probably caused by a new object than by an object that is already being tracked. In the next phase (903) the status information of each object being tracked is updated on the basis of the sensor observations linked to it. Finally (904) the set event conditions are examined, and event information (905) according to the fulfillment of the event conditions is produced.

It is obvious to the person skilled in the art that the exemplary embodiments presented above are, for the sake of clarity, comparatively simple in their structure and function. Following the model presented in this patent application it is possible to construct different and also very complex solutions that utilize the inventive concept presented in this patent application.

The invention claimed is:

1. A system for detecting an object and an event linked to the object, which system comprises a sensor field comprising two or more sensors in the vicinity of the object that are suited to the detective measurement of touch or pressure, measuring electronics that produces sensor observations by means of the sensors, and a data processing system suited for processing sensor observations, comprising a processor and a memory, wherein the data processing apparatus is arranged to detect the object and the event or events linked to the object on the basis of one or more sensor observations, wherein the system also comprises means for producing an estimate applying to the status of the object to be tracked using information recorded earlier about the status of the object and the length of time that has passed from the moment in time it describes wherein the system further comprises a structure that delimits the space and an arrival area where the system processes the observations made at a certain time, and records a new object which appears in the arrival area and links the observations to the new object, and an exit area where the system has processed the observations and has correspondingly updated the status information of the objects being tracked and wherein the system uses information about the changes in the status information of the objects to determine if an object has exited the delimited space.

2. The system according to claim 1, wherein the sensor observations used for detecting the aforementioned object and/or the aforementioned event are sequential in time.

3. The system according to claim 1, wherein the sensor field comprises, on average, at least 4 sensors per square meter.

4. The system according to claim 1, wherein the strength of the sensor observations varies according to the size, distance and/or material of the object being observed.

5. The system according to claim 1, wherein the system comprises means for detecting the aforementioned object by determining the area, shape of the observation caused by the object and/or the extent of the observations caused by the object in the sensor field and/or the strength of one or more sensor observations.

6. The system according to claim 1, wherein the system further comprises:

a) means for including the aforementioned object in the tracking by recording at least one item of status information, which describes the position, speed, acceleration, size, shape, extent, density, way of moving or other characteristic of the object, b) means to produce an association between at least one object included in the tracking and the sensor observations, which association links the observations to the objects included in the tracking, taking into account the aforementioned estimate applying to the status of at least one object to be tracked applicable to the time of the sensor observations, and the purpose of which association is according to how the aforementioned objects caused the aforementioned sensor observations, and c) means to maintain at least one item of status information of the aforementioned at least one object to be tracked using at least one sensor observation linked to the aforementioned object according to the aforementioned association.

7. The system according to claim 6, wherein the system comprises:

(a) means to produce the aforementioned association between the objects to be tracked and the sensor observations, which association comprises at least one new object in addition to the aforementioned at least one object included in the tracking, and (b) means to include the aforementioned at least one new object in the tracking by recording the aforementioned at least one item of status information describing it.

8. The system according to claim 1, wherein the event linked to an object is at least one of the following: a movement in the area to be monitored, an arrival in the area to be monitored, an exit from the area to be monitored, stopping or falling.

9. The system according to claim 1, wherein the system comprises means for detecting an event by detecting at least one change in the extent of the observations caused by at least one object, in the shape of the outline formed by these observations, in the location, direction of movement, speed of this outline, in the strength of the sensor observation caused by one or more and/or in at least one aforementioned item of status information such that the system compares the aforementioned at least one change to the information contained in at least one event condition.

10. The system according to claim 1, wherein the system comprises means for linking sensor observations that are sequential in time to an object in order to detect an event linked to the object or to identify the object.

11. The system according to claim 1, wherein the system comprises means to select an identification profile for the object from a plurality of known identification profiles according to the observations caused by the object and/or the aforementioned at least one item of status information.

12. A method performed by the system according to claim 1, for identifying an object and an event linked to the object.

13. The system according to claim 6, wherein the system comprises means for detecting an event by detecting at least one change in the extent of the observations caused by at least one object, in the shape of the outline formed by these observations, in the location, direction of movement, speed of this outline, in the strength of the sensor observation caused by one or more and/or in at least one aforementioned item of status information such that the system compares the aforementioned at least one change to the information contained in at least one event condition.

14. The system according to claim 7, wherein the system comprises means for detecting an event by detecting at least one change in the extent of the observations caused by at least one object, in the shape of the outline formed by these observations, in the location, direction of movement, speed of this outline, in the strength of the sensor observation caused by one or more and/or in at least one aforementioned item of status information such that the system compares the aforementioned at least one change to the information contained in at least one event condition.

15. The system according to claim 6, wherein the system comprises means to select an identification profile for the object from a plurality of known identification profiles according to the observations caused by the object and/or the aforementioned at least one item of status information.

16. The system according to claim 7, wherein the system comprises means to select an identification profile for the object from a plurality of known identification profiles according to the observations caused by the object and/or the aforementioned at least one item of status information.

* * * * *